US009901156B2

(12) United States Patent
Nagao

(10) Patent No.: US 9,901,156 B2
(45) Date of Patent: Feb. 27, 2018

(54) DRAWING APPARATUS AND DRAWING METHOD FOR DRAWING APPARATUS

(71) Applicant: CASIO COMPUTER CO., LTD., Shibuya-ku, Tokyo (JP)

(72) Inventor: Tomoyuki Nagao, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/387,331

(22) Filed: Dec. 21, 2016

(65) Prior Publication Data

US 2017/0181520 A1 Jun. 29, 2017

(30) Foreign Application Priority Data

Dec. 24, 2015 (JP) ..... 2015-252308

(51) Int. Cl.

| | |
|---|---|
| ***G06K 15/00*** | (2006.01) |
| ***A45D 29/00*** | (2006.01) |
| ***A45D 34/04*** | (2006.01) |

(52) U.S. Cl.

CPC ..... *A45D 29/00* (2013.01); *A45D 34/04* (2013.01); *A45D 2029/005* (2013.01)

(58) Field of Classification Search

None

See application file for complete search history.

(56) References Cited

U.S. PATENT DOCUMENTS

| | | | | |
|---|---|---|---|---|
| 5,931,166 | A * | 8/1999 | Weber | A45D 34/04 132/200 |
| 6,067,996 | A * | 5/2000 | Weber | A45D 34/04 132/200 |
| 6,286,517 | B1 * | 9/2001 | Weber | A45D 29/00 132/200 |
| 2005/0002560 | A1 * | 1/2005 | Yamamoto | G06K 9/3233 382/156 |
| 2005/0232477 | A1 * | 10/2005 | Sugihara | G03F 1/84 382/149 |
| 2012/0113171 | A1 * | 5/2012 | Murata | B41J 3/407 347/2 |
| 2013/0010291 | A1 * | 1/2013 | Tamamushi | G01N 21/95607 356/237.5 |

FOREIGN PATENT DOCUMENTS

JP 2003534083 A 11/2003

* cited by examiner

*Primary Examiner* — Ted Barnes
(74) *Attorney, Agent, or Firm* — Holtz, Holtz & Volek PC

(57) ABSTRACT

A drawing apparatus includes an object mounting portion on which an object is mounted, the object being at least one finger or toe having a nail, and a processor.

The processor detects an actual outline, which indicates an actual shape of an outer periphery of the nail, based on an image obtained by imaging the nail of the object mounted on the object mounting portion; creates an interpolation outline with respect to the actual outline other than a root portion of the nail, from the image, wherein the interpolation outline is an outline in which the actual outline is interpolated to eliminate a concavity in cases where the actual outline other than the root portion of the nail has the concavity; and determines whether or not the nail has a damaged portion on the basis of a comparison of the interpolation outline with the actual outline.

17 Claims, 6 Drawing Sheets

DRAWING APPARATUS AND DRAWING METHOD FOR DRAWING APPARATUS

CROSS-REFERENCE TO RELATED APPLICATIONS

The present invention contains subject matter related to Japanese Patent Application No. 2015-252308 filed in the Japanese Patent Office on Dec. 24, 2015, the entire contents of which are incorporated herein by reference.

BACKGROUND OF THE INVENTION

1. Field of the Invention

The present invention relates to a drawing apparatus and a drawing method for a drawing apparatus.

2. Description of the Related Art

Conventionally, drawing apparatuses (nail printing apparatus) for drawing nail designs such as colors, and patterns on the surface of nails are known. An example of such a drawing apparatus is described in Japanese Unexamined Patent Application Publication (Translation of PCT Application) No. 2003-534083.

Applying a plotter drawing apparatus, in which a drawing utensil (a drawing tool, namely a pen) for performing the drawing is mounted, to such a drawing apparatus is also being investigated.

Compared to an ink jet type drawing apparatus in which small droplets of ink are discharged, there are fewer restrictions related to the viscosity of usable inks, the particle size of the coloring material included in the ink, and the like in cases where drawing is performed using a pen. With the latter, inks with excellent color development that include coloring material that has a large particle size, and high-viscosity inks such as light-curable inks can be used. With such drawing apparatuses, it is possible to draw various types of nail designs, the same as would be performed at a nail salon.

Drawing apparatuses in which a pen is used are configured such that drawing is performed on a nail in a state where the pen is in contact with the surface of the nail. As such, in cases where the drawing object, namely the nail, has a damaged portion such as a chip, or a crack, the pen tip may catch or get stuck on the damaged portion when attempting to draw at this location.

Moving the pen in such a state may result in a major accident (injury) such as, for example, the caught pen tip cracking the nail even further or peeling the nail off.

Thus, when performing drawing on nail that has a damaged portion such as a chip, or a crack, there are cases where the nail design does not turn out as expected and the finish is not beautiful.

BRIEF SUMMARY OF THE INVENTION

The present invention is advantageous in that a drawing apparatus and a drawing method for a drawing apparatus are provided whereby a condition of a drawing object, the drawing object being a nail, is determined and, as a result thereof, drawing processing on the drawing object can be performed safely and a certain degree of drawing quality can be ensured.

A drawing apparatus of the present invention by which the advantages described above are obtained includes an object mounting portion on which an object, namely at least one finger or toe, is mounted, and a processor. In such a drawing apparatus, the processor detects an actual outline, which indicates an actual shape of an outer periphery of a nail, from a captured image. The captured image is obtained by imaging a nail that constitutes a drawing object of the object mounted on the object mounting portion. Furthermore, the processor creates an interpolation outline from the captured image in which the outline of the outer periphery of the nail is smoothly interpolated; and determines whether or not the nail has a damaged portion on the basis of a comparison of the interpolation outline with the actual outline.

In a drawing method for a drawing apparatus of the present invention by which the advantages described above are obtained, the drawing apparatus includes an object mounting portion on which an object, namely at least one finger or toe is mounted. The drawing method includes an actual outline detection step of detecting an actual outline, which indicates an actual shape of an outer periphery of a nail, from a captured image. The captured image is obtained by imaging a nail that constitutes a drawing object of the object mounted on the object mounting portion. The drawing method further includes an interpolation outline creation step of creating an interpolation outline, in which an outline of the outer periphery of the nail is smoothly interpolated, from the captured image; and a damaged portion determination step of determining whether or not the nail has a damaged portion on the basis of a comparison of the interpolation outline with the actual outline.

DETAILED DESCRIPTION OF THE INVENTION

Figure 1B:
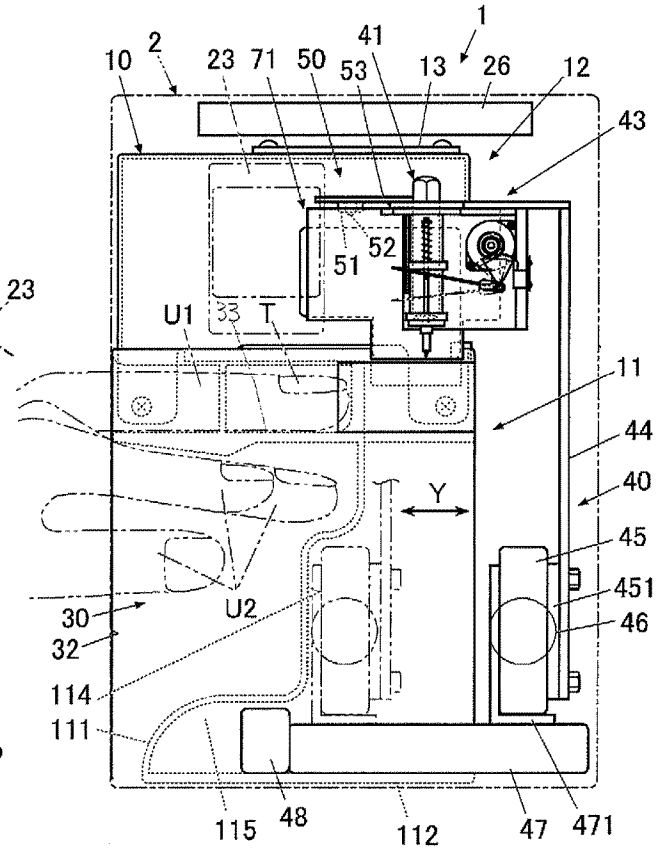
FIG. 1B is a side view illustrating an internal configuration of the drawing apparatus illustrated in FIG. 1A.

An embodiment of the nail printing apparatus (drawing apparatus) and drawing method for the nail printing apparatus (drawing apparatus) according to the present invention is described below in detail while referring to the drawings.

While various limitations, which are technically preferable from the perspective of carrying out the present invention, are placed on the embodiment described below, the scope of the present invention should not be construed to be limited to the embodiment or the example illustrated in the drawings.

In the following embodiment, a nail printing apparatus 1 will be described as an apparatus for drawing on a drawing object, namely a fingernail. However, the drawing object of the present invention is not limited to a fingernail and, for example, may be a toenail.

Figure 1A:
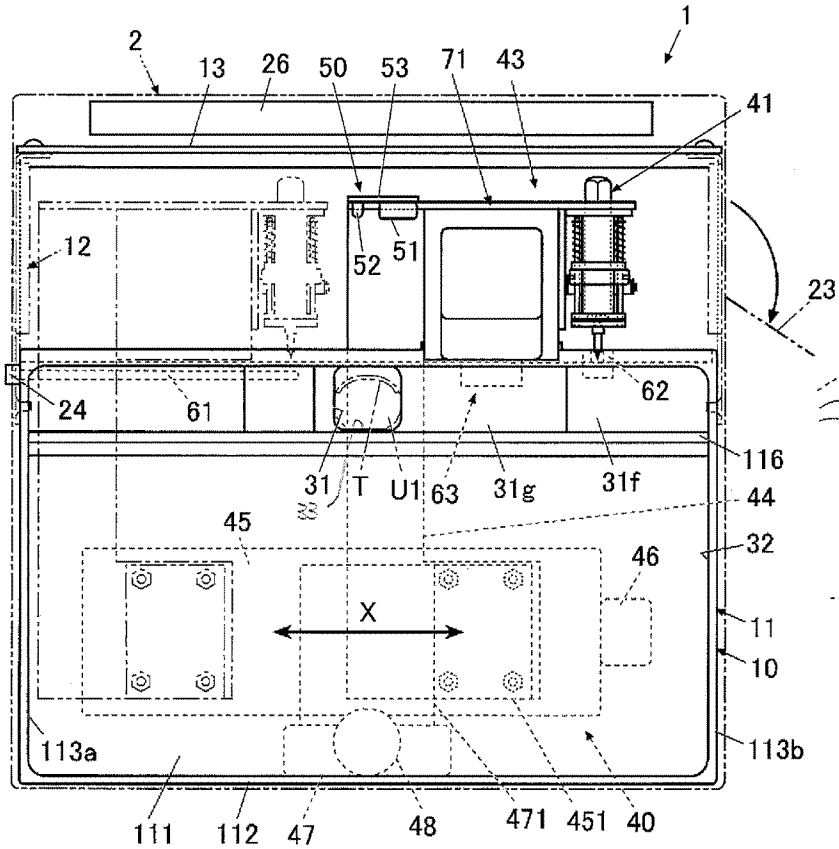
FIG. 1A is a front view of a drawing apparatus according to an embodiment of the present invention.

FIG. 1A is a front view of a nail printing apparatus 1, illustrating an internal configuration of the nail printing apparatus. FIG. 1B is a side view illustrating the internal configuration of the nail printing apparatus illustrated in FIG. 1A.

As illustrated in FIGS. 1A and 1B, in the nail printing apparatus 1 of the present embodiment, a drawing head 43 is provided with drawing tools, namely a pen 41 and an ink jet drawing portion 71. The nail printing apparatus 1 of the present embodiment uses plotter printing and ink jet printing to perform a drawing on a nail T of a print finger U1.

The nail printing apparatus 1 is provided with a case body 2 and an apparatus main body 10 housed in the case body 2.

A cover 23, configured to be openable and closeable, for replacing the pen 41 and the ink jet drawing portion 71 of the hereinafter described drawing unit 40 is provided in an end of an upper portion of a side surface of the case body 2.

The cover 23 is pivotable via, for example, a hinge or the like, from a closed state to an open state, as illustrated in FIG. 1A.

An operation unit 25 (see FIG. 3) is set on an upper surface (top panel) of the case body 2.

The operation unit 25 is an input unit where a user performs various types of input.

Operation buttons (not illustrated) for performing various types of input are set in the operation unit 25. Examples of the operation buttons include a power switch button for turning on the power of the nail printing apparatus 1, a stop switch button for stopping operation, a design selection button for selecting a design image to be drawn on the nail T, a drawing start button for commanding the drawing to start, and the like.

A display unit 26 is set approximately in a center portion of the top surface (top panel) of the case body 2.

The display unit 26 is configured from, for example, a liquid crystal display (LCD), an organic electroluminescence display, or other type of flat display.

In the present embodiment, examples of images appropriately displayed on the display unit 26 include nail images obtained by imaging the print finger U1 (finger images including images of the nail T), images of the outline or the like of the nail T included in the nail images, design selection images for selecting a design image to be drawn on the nail T, thumbnail images for design confirmation, command screens displaying various commands, and the like.

As described hereinafter, in the present embodiment, a configuration is provided in which the display unit 26 is caused to display a notification in cases where the nail T has a damaged portion Ba (see FIG. 4A) so as to inform and alert a user. Thus, the display unit 26 functions as notification unit.

Note that a configuration is possible in which a touch panel for performing various types of input is integrated into the surface of the display unit 26.

The apparatus main body 10 is formed into a rough box-shape and is provided with a lower frame 11 set in the lower portion of the interior of the case body 2, and an upper frame 12 set above the lower frame 11 and in the upper portion of the interior of the case body 2.

First, the lower frame 11 will be described.

The lower frame 11 has a back surface plate 111, a bottom plate 112, a pair of left and right side plates 113*a* and 113*b*, an X-direction movement stage housing 114, a Y-direction movement stage housing 115, and a dividing wall 116.

Bottom edges of the side plates 113*a* and 113*b* are joined respectively to left and right edges of the bottom plate 112. The side plates 113*a* and 113*b* are provided in an upright state on the bottom plate 112.

A lower portion of the back surface plate 111 is formed so as to sink forward (toward the finger insertion direction proximal side) in two stages. The bottom edge of the back surface plate 111 is joined to a front edge of the bottom plate 112, and the back surface plate 111 divides the area surrounded by the bottom plate 112 and the side plates 113*a* and 113*b* into front and back.

The space formed on the back side of the sunken back surface plate 111 becomes the X-direction movement stage housing 114 and the Y-direction movement stage housing 115 (see FIG. 1B).

An X-direction movement stage 45 of the drawing unit 40 is housed in the X-direction movement stage housing 114 when the drawing unit 40 is moved forward (toward the finger insertion direction proximal side).

A Y-direction movement stage 47 of the drawing unit 40 is disposed in the Y-direction movement stage housing 115.

The dividing wall 116 is provided inside the lower frame 11 so as to vertically divide the space on the front side inside the lower frame 11 (the space on the finger insertion direction proximal side surrounded by the back surface plate 111, the bottom plate 112, and the side plates 113*a* and 113*b*).

The dividing wall 116 is provided roughly horizontally, left and right edges of the dividing wall 116 are joined respectively to the side plates 113*a* and 113*b*, and a back edge of the dividing wall 116 is joined to the back surface plate 111.

A finger securing portion 30 (see FIG. 1B) is provided integrally in the lower frame 11.

The finger securing portion 30 is configured from a finger receiving portion 31 for receiving the finger corresponding to the nail T (i.e. the drawing object) on which drawing will be performed (hereinafter referred to as "print finger U1"), and a finger clearing portion 32 for clearing fingers other than the print finger U1 (hereinafter referred to as "non-print fingers U2").

The finger receiving portion 31 is disposed on an upper side of the dividing wall 116 and, for example, slightly right of the center in a width direction of the lower frame 11.

The space on the lower side of the lower frame 11, partitioned by the dividing wall 116, forms the finger clearing portion 32.

For example, in cases where performing a drawing on the nail T of a ring finger, the ring finger is inserted into the finger receiving portion 31 as the print finger U1, and the non-print fingers U2, namely the other four fingers (thumb, index finger, middle finger, and little finger) are inserted into the finger clearing portion 32.

The finger receiving portion 31 is open to a front surface side of the lower frame 11 (print finger insertion direction proximal side); and a bottom side is a finger mount portion 33 that is constituted by a portion of a top side of the dividing wall 116.

The finger mount portion 33 is a constituent where the finger (the print finger U1) of the nail T on which drawing is to be performed is mounted on the X-Y plane.

A top side of the finger receiving portion 31 is open and a surface of the nail T of the print finger U1 inserted in the finger receiving portion 31 (i.e. the drawing object surface) is exposed.

A front wall 31*f* (see FIG. 1A) that closes the front surface side of the lower frame 11 is provided on the top surface of the dividing wall 116, at both end portions on the front surface side of the lower frame 11.

A pair of guide walls 31*g* (see FIG. 1A) that guides the print finger U1 into the finger receiving portion 31 is erected on the top surface of the dividing wall 116, and the pair of guide walls 31*g* narrows from the end of the front wall 31*f* on the center portion side toward the finger receiving portion 31.

A user can pinch the dividing wall 116 between the print finger U1 inserted in the finger receiving portion 31 and the non-print fingers U2 inserted in the finger clearing portion 32. Thus, the print finger U1 inserted in the finger receiving portion 31 is stably secured.

A test drawing portion 61 is provided on the top surface of the lower frame 11, beside the finger receiving portion 31 (location corresponding to a media access port 24 of the case body 2, on the left side in FIG. 1A). The test drawing portion 61 is for performing test drawing to warm up a pen tip 413 (described hereinafter) to eliminate fading and the like at a time of beginning of drawing by the pen tip (tip portion) 413 of the pen 41 within a drawable area of the drawing head 43 (described hereinafter).

The test drawing portion 61 is a flat portion and is configured so that drawing media (not illustrated) inserted through the media access port 24 of the case body 2 is mounted thereon.

The drawing media mounted on the test drawing portion 61 is not limited, provided that test drawing of the pen tip (tip portion) 413 can be performed, and for example, may be a piece of paper.

A pen cap 62 is disposed within a movable range of the drawing head 43 (described hereinafter) on the top surface of the lower frame 11, on a side opposite the test drawing portion 61 across the finger receiving portion 31 (in the present embodiment, the right side in FIG. 1A). The number of the pen cap 62 disposed (one in the present embodiment) corresponds to the number of a pen holder 42 (described hereinafter).

The pen cap 62 is formed, for example, from rubber, and at times when the pen 41 is mounted to the drawing unit 40 but not drawing (when not drawing), drying out of the pen tip 413 is prevented by lowering the pen 41 and storing the pen tip 413 in the pen cap 62.

An ink jet maintenance portion 63 is provided at a position corresponding to a position where the ink jet drawing portion 71 is disposed when the pen tip 413 is stored in the pen cap 62. The ink jet maintenance portion 63 is configured from, for example, a cleaning mechanism for cleaning an ink discharging portion (nozzle surface) of the ink jet drawing portion 71 described hereinafter, a cap mechanism for maintaining moist conditions of the ink discharging portion (nozzle surface), and the like (all not illustrated).

Note that the disposal of the pen cap 62, the ink jet maintenance portion 63, and the like is not limited to the examples described herein.

The drawing unit 40 is configured from and provided with the drawing head 43, a unit supporting member 44 that supports the drawing head 43, the X-direction movement stage 45 for moving the drawing head 43 in the X direction (the X direction in FIG. 1A; the left-right direction of the drawing apparatus 1), an X-direction movement motor 46, the Y-direction movement stage 47 for moving the drawing head 43 in the Y direction (the Y direction in FIG. 1B; the front-back direction of the drawing apparatus 1), a Y-direction movement motor 48, and the like.

Figure 2A:
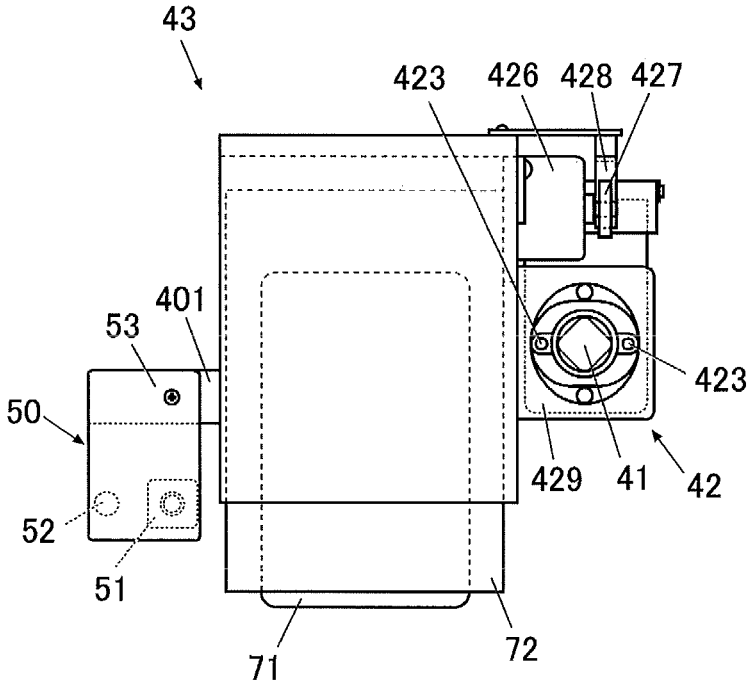
FIG. 2A is a top view of a drawing head according to the embodiment of the present invention.
Figure 2B:
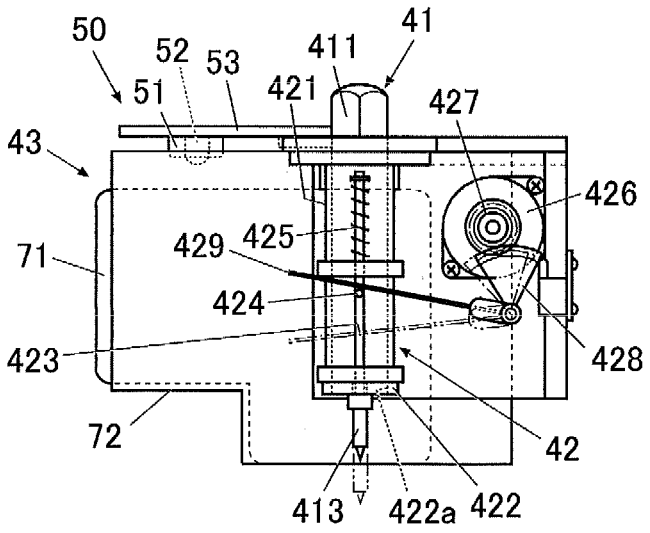
FIG. 2B is a side view of the drawing head according to the embodiment of the present invention.

FIG. 2A is a top view of a drawing head and FIG. 2B is a side view of the drawing head according to the present embodiment.

As illustrated in FIGS. 2A and 2B, in the drawing head 43 of the present embodiment, the pen holder 42 holding the pen 41 and an ink jet holder 72 holding the ink jet drawing portion 71 are disposed adjacently to each other.

The ink jet drawing portion 71 is, for example, an ink cartridge-integrated head in which ink cartridges (not illustrated) corresponding to yellow (Y), magenta (M), and cyan (C) ink are formed integrally with an ink discharging portion (not illustrated) provided on a surface (in the present embodiment, the bottom surface in FIG. 1A and the like) facing the drawing object (the nail T) in each of the ink cartridges.

The ink discharging portion is provided with a nozzle array consisting of a plurality of nozzles for spraying each color of ink. The ink jet drawing portion 71 micronizes the ink and performs the drawing by spraying the ink from the ink discharging portion directly on the target drawing surface of the drawing object (the nail T).

Note that the ink jet drawing portion 71 is not limited to those that discharge the three colors of ink described previously. Ink cartridges holding other colors of ink and ink discharging portions may also be provided.

One pen 41 is mountable in the pen holder 42 of the present embodiment, and this pen 41 is replaceable in the pen holder 42.

The pen 41 is a writing utensil that has the surface of the nail T as its drawing object surface, and performs a drawing by the tip portion thereof being brought into contact with the drawing object surface, namely the surface of the nail T.

As illustrated in FIG. 2B and the like, the pen 41 is provided with the pen tip 413 on a tip side (the lower side in FIG. 2B) of a rod-like pen shaft portion 411.

An interior of the pen shaft portion 411 is an ink storing portion for storing various types of ink.

Any type of ink can be stored in the interior of the pen shaft portion 411. Viscosity of ink, diameter of the coloring particles (particle size), and the like are not particularly limited and, for example, ink containing metallic glitter, white ink, UV-curable ink, ink for gel nails, ink for under coats, ink for top coats, nail varnish, and the like can be used.

In the present embodiment, the pen 41 is a ballpoint pen in which the pen tip 413 draws by the ink stored in the pen shaft portion 411 being dispensed by pressing the pen tip 413 against the surface of the nail T.

Note that the pen 41 is not limited to a ballpoint pen. For example, the pen 41 may be a felt-tip pen that draws by soaking ink into a felt-like pen tip, a brush pen that draws by soaking ink into a bundle of hairs, or the like.

The pen 41 having the pen tip 413 of any desired thickness may be used as well.

Each of the pens 41 that is replaced and set in the pen holder 42 may be pens that all have the same type of the pen tip 413, or may be pens that have different types of the pen tip 413.

The pen 41 is held by simply inserting it in the pen holder 42 from above. As such, the pen 41 can be easily replaced by a user by opening the cover 23 provided in the case body 2 and, for example, using hands or tweezers to grab a top end portion of the pen shaft portion 411 and lift the pen 41 out.

Thus, a user can realize a wide range of nail designs by appropriately replacing the pen 41 set in the pen holder 42 for a pen 41 having a different color or a different pen tip 413, or using a different type of ink, depending on the nail design desired to be drawn.

The pen holder 42 is provided with a tubular member 421 that is open vertically and into which the pen 41 is inserted, a pen retaining member 422 disposed so as to block an opening on a bottom side of the tubular member 421 (the bottom side in FIG. 2B), and an auxiliary rod member 423 that moves vertically with the pen 41.

A retaining hole 422*a* that retains the tip side of the pen shaft portion 411 of the pen 41 is formed in the pen retaining member 422. The pen 41 is retained in the pen holder 42 by the tip side of the pen shaft portion 411 being inserted in the retaining hole 422*a* of the pen retaining member 422. Note that screw grooves (not illustrated) may be formed in an outer circumferential surface of the tip side of the pen shaft portion 411, screw grooves (not illustrated) capable of mating with the screw grooves of the shaft portion may be formed in an inner circumferential surface of the retaining hole 422*a*, and the pen 41 may be retained in the retaining hole 422*a* by screwing the screw grooves on the pen shaft portion 411 side into the screw grooves on the retaining hole 422*a* side.

In the present embodiment, two auxiliary rod members 423 are disposed so as to sandwich the pen 41. A bottom end of each of the auxiliary rod members 423 is mated with the pen retaining member 422 and, thereby, the auxiliary rod members 423 are fixed so as to be parallel with the pen shaft portion 411 of the pen 41.

A retaining protrusion 424 protruding in a direction away from the axial center of the pen 41 is provided on the auxiliary rod members 423.

A coil spring 425 is wrapped around the rod of the auxiliary rod members 423. The coil spring 425 is configured to apply force in an upward direction to the auxiliary rod member 423 in a state free of external forces and holds the position of the pen 41 when not drawing at a position where the pen tip 413 does not come into contact with the nail T.

A pen vertical motor 426 constituted by a stepping motor, a gear 428 that engages with a gear 427 attached to a rotating shaft of the pen vertical motor 426, and a plate spring 429 that pivots along with the rotation of the gear 428 are provided in the vicinity of the pen holder 42.

In the present embodiment, a lifting mechanism of the pen 41 is constituted by the pen vertical motor 426, the gear 427, the gear 428, the plate spring 429, and the like.

When not drawing, the plate spring 429 does not apply external forces to the retaining protrusion 424 and, in this state, the pen 41 is pushed in an upward direction (the upward direction in FIGS. 1A and 2B) by the biasing force of the coil spring 425. Thus, the tip portion of the pen 41, namely the pen tip 413, is separated from the drawing object surface, namely the surface of the nail T, and held at a height where the pen tip 413 does not come into contact with the surface.

On the other hand, when drawing, the pen vertical motor 426 rotates a prescribed number of steps, resulting in the plate spring 429 pivoting. At this time, the plate spring 429 engages with the retaining protrusion 424 provided on the auxiliary rod member 423 and presses the retaining protrusion 424 downward.

Thus, the pen 41 is pressed downward against the biasing force of the coil spring 425, and the pen tip 413 comes into contact with the surface of the nail T.

The plate spring 429 flexes a suitable degree and, as a result, impact caused by the vertical movement of the pen 41 is absorbed by the plate spring 429 and the pen 41 moves vertically along with the height of the nail T while maintaining a suitable degree of pen pressure of the pen tip 413 in a roughly constant manner. Thus, the desired nail design can be drawn neatly on the surface of the drawing object, namely the nail T.

The unit supporting member 44 is fixed to an X-direction movement portion 451 that is attached to the X-direction movement stage 45.

The X-direction movement portion 451 is configured to move in the X direction along guides (not illustrated) on the X-direction movement stage 45 via the driving of the X-direction movement motor 46. Thus, the drawing head 43 that is attached to the unit supporting member 44 is configured to move in the X direction (the X direction in FIG. 1A and the left-right direction of the nail printing apparatus 1).

The X-direction movement stage 45 is fixed to a Y-direction movement portion 471 of the Y-direction movement stage 47. The Y-direction movement portion 471 is configured to move on the Y-direction movement stage 47 in the Y direction along a guide (not illustrated) via the driving of the Y-direction movement motor 48. Thus, the drawing head 43 that is attached to the unit supporting member 44 is configured to move in the Y direction (the Y direction in FIG. 1B and the front-back direction of the nail printing apparatus 1).

Note that in the present embodiment, the X-direction movement stage 45 and the Y-direction movement stage 47 are configured from combinations of the X-direction movement motor 46, the Y-direction movement motor 48, and ball screws and guides (not illustrated).

In the present embodiment, a head movement portion 49 is configured as an XY drive unit that drives the drawing head 43 provided with the pen 41 in the X direction and the Y direction via the X-direction movement motor 46, the Y-direction movement motor 48, and the like.

The pen vertical motor 426, the ink jet drawing portion 71, the X-direction movement motor 46, and the Y-direction movement motor 48 of the drawing unit 40 are connected to a drawing control portion 815 of a control device 80 (see FIG. 3; described hereinafter), and are configured to be controlled by the drawing control portion 815.

An imaging unit 50 is provided with an image capturing device 51 and an illumination device 52.

The imaging unit 50 illuminates the nail T of the print finger U1, which is inserted into the finger receiving portion 31 and is visible through the opening of the upper portion, using the illumination device 52.

Moreover, the print finger U1 is imaged using the image capturing device 51 and, a captured image of the nail T of the print finger U1, namely a nail image (image of finger including nail image) is acquired.

In the present embodiment, the image capturing device 51 and the illumination device 52 are fixed on a side (the left side of the drawing head 43 in FIG. 1A) of the drawing head 43 of the drawing unit 40.

Specifically, as illustrated in FIG. 2A, the drawing head 43 of the drawing unit 40 has an overhanging portion 401 overhanging in a lateral direction from a first edge (the left side in FIG. 2A) of the top surface of the drawing head 43, and a substrate 53 is attached to the overhanging portion 401.

The image capturing device 51 and the illumination device 52 constituting the imaging unit 50 are provided on a bottom surface of the substrate 53 so as to face the dividing wall 116.

Note that a size of the substrate 53 and positions where the image capturing device 51 and the illumination device 52 are attached to the substrate 53 are not particularly limited.

The image capturing device 51 is, for example, a small camera having a solid state image sensor with a pixel count of about 2 million pixels or greater, a lens, and the like.

In the present embodiment, a nail shape detection portion 812 (see FIG. 3) detects an actual outline La (see FIG. 4A) indicating the actual shape of the outer periphery of the nail T, on the basis of the captured images (the nail images) acquired by the image capturing apparatus 51.

The nail shape detection portion 812 detects a position of the nail T on the X-Y plane, a vertical position of the nail T, and other nail information on the basis of the captured images (the nail images).

Note that the image capturing device 51 is preferably configured to be moved by the head movement portion 49 so as to image the nail T from differing positions or angles and acquire a plurality of captured images (nail images) and, thereby, detect the curvature and the like of the nail T of the print finger U1.

In cases where the image capturing device 51 acquires a plurality of captured images (nail images), the nail shape detection portion 812 (see FIG. 3) can detect the curvature of the nail T on the basis of these captured images (nail images).

The illumination device 52 is, for example, a white LED or similar light source.

In the present embodiment, the illumination device 52 is disposed beside the image capturing device 51 (on the left side of the image capturing device 51 in FIGS. 1A and 2A).

The illumination device 52 radiates light downward and illuminates at least an imaging area below the image capturing device 51.

The position of the illumination device 52 with respect to the image capturing device 51 is fixed. Note that the disposal and number of the illumination devices 52 provided is not limited to the illustrated examples.

The imaging unit 50 is connected to an imaging control portion 811 of the control device 80 (described hereinafter, see FIG. 3), and is configured to be controlled by the imaging control portion 811.

Note that image data of the image imaged by the imaging unit 50 is stored in a nail image memory region 821 of a memory unit 82 (described hereinafter).

The control device 80 is, for example, arranged on a substrate 13 or the like disposed in the upper frame 12.

Figure 3:
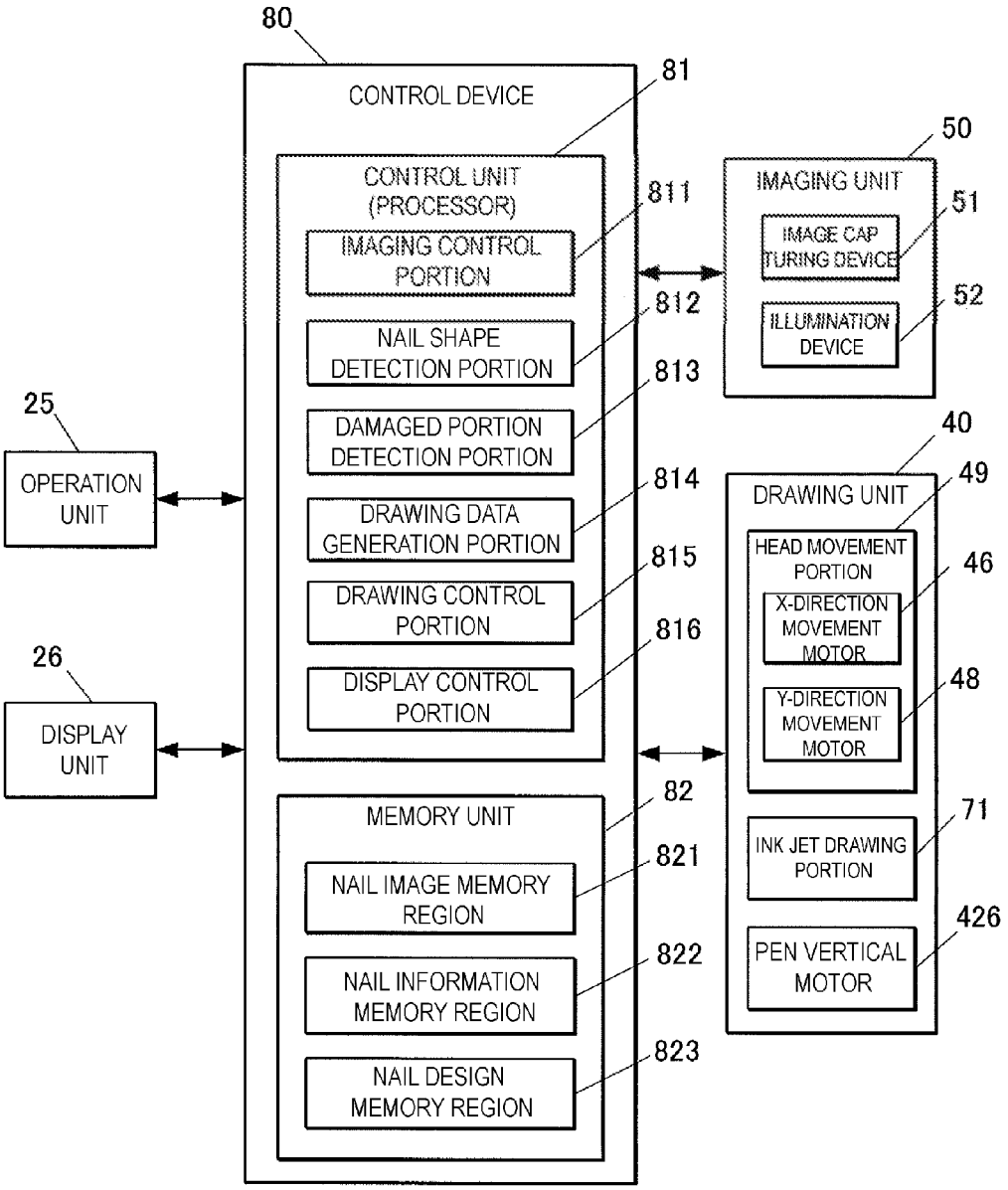
FIG. 3 is a main constituent block diagram showing a control configuration of the drawing apparatus according to the embodiment of the present invention.

FIG. 3 is a main constituent block diagram showing the control configuration according to the present embodiment.

As illustrated in FIG. 3, the control device 80 is a computer provided with a control unit (processor) 81 constituted by a central processing unit (CPU) (not illustrated), and a memory unit 82 constituted by a read only memory (ROM), a random access memory (RAM), or the like (neither illustrated).

Various programs to operate the nail printing apparatus 1, various data, and the like are stored in the memory unit 82.

Specifically, various programs are stored in the ROM of the memory unit 82 such as an actual outline detection program for detecting an actual outline indicating the actual shape of the outer periphery of the nail T from the nail images (the captured images); an interpolation outline creation program for creating an interpolation outline of the nail T from the nail images (the captured images); a nail information detection program for detecting various types of nail information such as curvature in the width direction of the nail T, the width of the nail T, and the area of the nail T; a damaged portion determination program for determining whether or not the nail T has a damaged portion; a drawing data generation program for generating drawing data; and a drawing program for performing drawing processing. A configuration is provided whereby these programs are executed by the control device 80 and, thus, the components of the nail printing apparatus 1 are controlled in an integrated manner.

In the present embodiment, the memory unit 82 is provided with the nail image memory region 821 where the nail image (captured image) of the nail T of the print finger U1 of a user acquired by the imaging unit 50 is stored, a nail information memory region 822 where the nail information detected by the nail shape detection portion 812 (the actual outline indicating the actual shape of the outer periphery of the nail T, the curvature of the nail T, and the like) and the interpolation outline of the nail T created by the damaged portion determination portion 813 are stored, a nail design memory region 823 where image data of a nail design to be drawn on the nail T is stored, and the like.

When viewed from a function perspective, the control unit 81 is provided with the imaging control portion 811, the nail shape detection portion 812, the damaged portion determination portion 813, a drawing data generation portion 814, the drawing control portion 815, a display control portion 816, and the like. Functions of the imaging control portion 811, the nail shape detection portion 812, the damaged portion determination portion 813, the drawing data generation portion 814, the drawing control portion 815, the display control portion 816, and the like are realized by cooperation of the CPU of the control unit 81 and the programs stored in the ROM of the memory unit 82.

The imaging control portion 811 is configured to cause the image capturing device 51 to image finger images, that is, nail images (captured images) including images of the nail T of the print finger U1 inserted into the finger receiving portion 31, by controlling the image capturing device 51 and the illumination device 52 of the imaging unit 50.

In the present embodiment, while the imaging device 50 is moved by the drawing control portion 815 that controls the head movement portion 49, the imaging control portion 811 causes the image capturing apparatus 51 to image the nail T from a plurality of positions or angles in the width direction of the nail T (e.g. directly above the nail T and diagonally above the nail T, or the like), and acquire a plurality of the nail images (captured images).

Note that the number of captured images acquired for one nail T is not particularly limited, but it is preferable that two or more captured images be acquired from different positions in the width direction of the nail T because it will be possible to perform accurate detection, including the detection of the curvature of the nail T.

The image data of the nail image acquired by the imaging unit 50 is stored in the nail image memory region 821 of the memory unit 82.

The nail shape detection portion 812 is configured to detect the nail information on the nail T of the print finger U1 on the basis of the images (captured images) of the nail T of the print finger U1 inserted into the finger receiving portion 31, the image being imaged by the image capturing device 51.

In the present embodiment, the nail shape detection portion 812 detects the actual outline La (depicted as a solid line in FIG. 4A) indicating the actual shape of the outer periphery of the nail T as the nail information, on the basis of the captured images.

For example, in cases where the nail T has chipped portions, cracks, or the like, such portions appear as irregularities, and these irregularities are included in the actual outline La, which is an outline indicating the actual shape of the outer periphery of the nail area.

The technique whereby the actual outline La of the nail T is detected is not particularly limited. For example, the actual outline La can be detected by edge detection processing or similar image processing.

Note that the nail information acquired by the nail shape detection portion 812 is not limited to the actual outline La. For example, the nail information may include the X-Y coordinates of the horizontal position of the nail T, the height of the nail T (position in the vertical direction of the nail T, hereinafter referred to as the "vertical position of the nail T" or simply the "position of the nail T"), the shape in the width direction of the nail T, that is, the inclination angle with respect to the X-Y plane of the surface of the nail T (the curvature of the nail T or the inclination angle of the nail T), and the like.

The nail information acquired by the nail shape detection portion 812 is stored in the nail information memory region 822 of the memory unit 82.

The damaged portion determination portion 813 creates an interpolation outline Lb of the nail T (depicted by dotted lines in FIG. 4A) from the images (the captured images) of the nail T of the print finger U1 inserted into the finger receiving portion 31, imaged by the image capturing apparatus 51.

The interpolation outline Lb is an outline generated by interpolating such that the actual outline of the outer periphery of the nail T, at portions other than the root side (the growing side) of the nail T, has a smooth shape. For example, in cases where the nail T has a concavity in a portion of the actual outline, the interpolation outline Lb is an outline generated by interpolating the actual outline so as to eliminate the concavity.

Specifically, the interpolated outline Lb is generated by providing a plurality of points on the actual outline of the outer periphery of the nail T, extracted by the nail shape detection portion 812, in the portions other than the root side of the nail T, and interpolating so as to smoothly connect between this plurality of points on the outline. Thus, the interpolated outline Lb is similar to the natural outline of the nail T.

Note that the technique whereby interpolating between the plurality of points is carried out is not particularly limited. For example, a technique such as linear interpolation, polynomial interpolation, or cubic spline interpolation may be used as the technique for interpolating between the plurality of points.

Note that the interpolation outline Lb is generated in cases of both where a concavity exists and where a concavity does not exist in the actual outline of the nail T. Moreover, in cases where a concavity does not exist in the actual outline of the nail T, the interpolation outline Lb is the same or is substantially the same as the actual outline La.

Figure 4A:
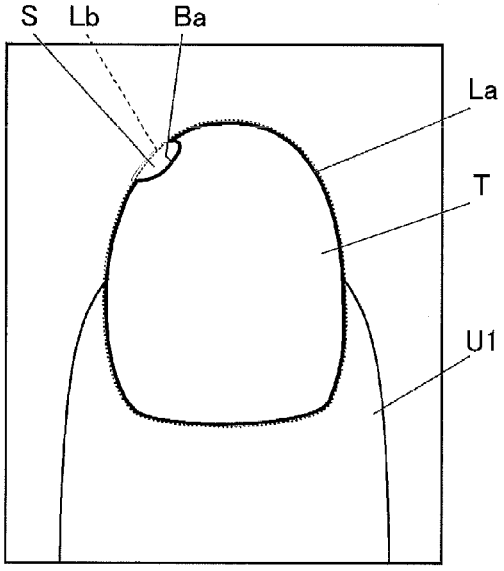
FIG. 4A is an explanatory drawing illustrating a state where the actual outline and the interpolation outline of the nail are compared.

Upon creation of the interpolation outline Lb, the damaged portion determination portion 813 compares the created interpolation outline Lb with the actual outline La detected by the nail shape detection portion 812 and, as a result, determines whether or not the nail T has a damaged portion Ba (see FIG. 4A).

Next, a detailed description is given regarding the determination by the damaged portion determination portion 813 of whether or not the nail has the damaged portion Ba.

A normal nail T without chips or cracks is free of irregularities in the outline and the outline forms a smooth, curved line. On the other hand, a nail T with chips or cracks has irregularities in the outline thereof.

As such, the damaged portion determination portion 813 determines whether or not the nail T has the damaged portion Ba by comparing the interpolation outline Lb of the nail T with the outline indicating the actual shape of the nail area, namely the actual outline La, and detecting a difference therebetween.

That is, in cases where the nail T does not have chips and cracks, the entire actual outline La will be smooth and when compared with the interpolation outline Lb, hardly any differences will appear.

In contrast, in cases where the nail T has chips or cracks, irregularities will appear in the actual outline La, but the irregularities corresponding to the chips and cracks will nearly disappear in the interpolation outline Lb in which the outline is smoothly interpolated. As a result, when comparing the actual outline La with the interpolation outline Lb, a difference will appear.

Figure 4B:
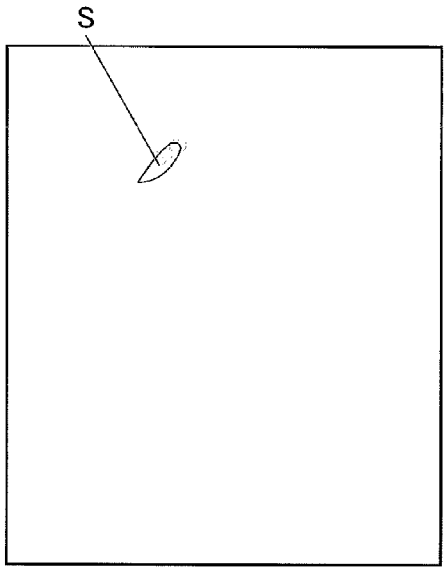
FIG. 4B is an explanatory drawing illustrating a difference portion between the actual outline and the interpolation outline.

When the damaged portion determination portion 813 of the present embodiment detects a difference, first, it is determined whether or not a value of the area of the difference portion S (see FIGS. 4A and 4B) is greater than or equal to a preset threshold.

Then, in cases where the value of the area of the difference portion S is greater than or equal to the preset threshold, whether or not the nail T has the damaged portion Ba is determined while taking into consideration a value obtained by dividing the circumferential length of the difference portion S by the value of the area of the difference portion S.

Here, the pen 41 performs the drawing in a state of contact with the surface of the nail T. As such, in cases where the nail T has a chip, a crack, or the like, and drawing is attempted at that location, the pen tip 413 may catch or get stuck at the chipped portion.

Especially, in cases where the pen 41 has a ballpoint pen tip 413, as is anticipated in the present embodiment, moving the pen 41 while the pen tip 413 is caught at the chipped portion may result in an injury to the user such as the caught pen tip 413 cracking the nail T even further or peeling the nail T off.

Here, in cases where the portion where chipping or cracking has occurred is smaller than the diameter of the pen tip 413, there is little possibility of the pen tip 413 becoming caught or stuck at the chipped portion. Accordingly, in these cases, there is no obstacle to performing the drawing processing as-is.

As such, the threshold of the value of the area is preferably the same or slightly greater than a value of the area of the pen tip 413 of the pen 41. For example, when a ball diameter of the pen tip 413 of the ballpoint pen 41 is approximately 1 mm, the threshold of the value of the area is set, for example, to 1 $mm^2$.

Note that the size of the chipped portion where there is a possibility of the pen tip 413 catching or stuck differs depending on the size, structure, material quality, and the like of the pen tip 413 of the pen 41. As such, the threshold of the value of the area is preferably set appropriately in accordance with the size, structure, material quality, and the like of the pen tip 413 of the pen 41 used in the drawing.

Note that even if the area of the difference portion S is large, provided that the difference portion S has a comparatively gentle shape along the outer edge of the nail T, there is little possibility of the pen tip 413 becoming caught or stuck at the chipped portion. As such, in these cases, there is no obstacle to performing the drawing processing as-is.

Thus, to appropriately determine whether or not a damaged portion Ba exists that presents a danger when performing the drawing processing, it is preferable that the shape of the chipped portion be considered in addition to the area of the difference portion S.

For example, when two difference portions S are compared and the areas of both are approximately the same, it can be determined that the difference portion S with the longer circumferential length has a narrow, gentle shape.

As such, in the present embodiment, in cases where the detected difference portion S has an area greater than or equal to a certain area and the value obtained by dividing the circumferential length of the difference portion by the value of the area of the difference portion satisfies a certain condition (that is, in cases where the value obtained by dividing the circumferential length of the difference portion S by the area of the difference portion S is smaller than a predetermined value), the damaged portion determination portion 813 determines that the nail T has a damaged portion Ba that is an obstacle to drawing.

Here, the predetermined value is appropriately set to a value at which it can be said that the shape is gentle to a degree that catching does not easily occur, in accordance with type of the pen 41, the shape of the pen tip 413, and the like.

Thus, even if the difference portion S exists, it is determined that the damaged portion Ba does not exist when the certain condition is not satisfied. As such, it is possible to perform the drawing processing in cases where there are simply fine irregularities and cracks that do not pose an obstacle to drawing.

Note that in cases where a plurality of difference portions S is detected, the damaged portion determination portion 813 determines whether or not each of the difference portions constitutes a damaged portion Ba for all of the difference portions S, on the basis of the standards described above. Then, in cases where it is determined that none of the difference portions S constitute a damaged portion Ba, it is determined that the damaged portion Ba does not exist.

In cases where it is determined by the damaged portion determination portion 813 that the nail T has the damaged portion Ba, the display unit 26, for example, is caused to display a message or the like to that effect. As a result, the user is informed of the existence of the damaged portion Ba that poses a danger to the performance of the drawing processing.

In these cases, the display unit 26 functions as notification unit for informing a user of the existence of the damaged portion Ba.

Note that the notification unit is not limited to the display unit 26. For example, a speaker or similar audio output unit may be provided as the notification unit, and the user may be audibly informed of the existence of the damaged portion Ba. The user may be informed of the existence of the damaged portion Ba both visually and audibly.

In the present embodiment, in cases where it is determined that the damaged portion Ba exists, subsequent drawing processing is canceled.

The drawing data generation portion 814 generates drawing data for the drawing to be performed by the drawing head 43 to the nail T of the print finger U1 on the basis of the nail information detected by the nail shape detection portion 813.

Specifically, on the basis of the shape of the nail T (the actual outline La) and the like detected by the nail shape detection portion 812, the drawing data generation portion 814 performs calibration processing, such as enlarging, reducing, and cropping, for calibrating the image data of the nail design to the shape of the nail T.

The drawing data generation portion 814 functions as an image data correction portion that performs appropriate curvature correction on the image data of the nail design specified to be drawn on the nail T, in accordance with the curvature of the nail T detected by the nail shape detection portion 812.

As a result, drawing data for the nail design to be drawn by the pen 41 or the ink jet drawing portion 71 is generated.

The drawing control portion 815 is a control portion that outputs control signals to the drawing unit 40 on the basis of the drawing data generated by the drawing data generation portion 814, and controls the X-direction movement motor 46, the Y-direction movement motor 48, the pen vertical motor 426, the ink jet drawing portion 71, and the like of the drawing unit 40, so as to perform a drawing on the nail T that corresponds with the drawing data.

Specifically, when the pen 41 is not drawing, the drawing control portion 815 controls the pen vertical motor 426 so as to maintain a state in which the retaining protrusion 424 is not pressed down by the plate spring 429; and, when the pen is drawing, the drawing control portion 815 causes the pen vertical motor 426 to operate and controls the operation of the pen vertical motor 426 so that the retaining protrusion 424 is pressed down by the plate spring 429 and the tip side (the pen tip 413) of the pen 41 comes into contact with the surface of the nail T.

Note that at locations where the height of the nail T changes greatly and cannot be accommodated by the flexible deformation (elastic deformation) of the plate spring 429 alone, the drawing control portion 815 preferably causes the number of steps of the pen vertical motor 426 to be increased or decreased, thus adjusting the pen pressure of the pen 41 so that the pen pressure becomes substantially constant.

The display control portion 816 is configured to control the display unit 26 and cause the display unit 26 to display various types of display screens. In the present embodiment, examples of the various types of display screens the display control portion 816 is configured to display on the display unit 26 include nail design selection screens and thumbnail images for confirming designs, nail images acquired by imaging the print finger U1, various command screens, operation screens, and the like.

In the present embodiment, as described above, a configuration is provided in which the display unit 26 is caused to function as notification unit for informing a user of the existence of the damaged portion Ba and, in cases where it is determined by the damaged portion determination portion 813 that the nail T has the damaged portion Ba, the display control portion 816 causes the display unit 26 to display a message or the like to that effect.

Figure 5:
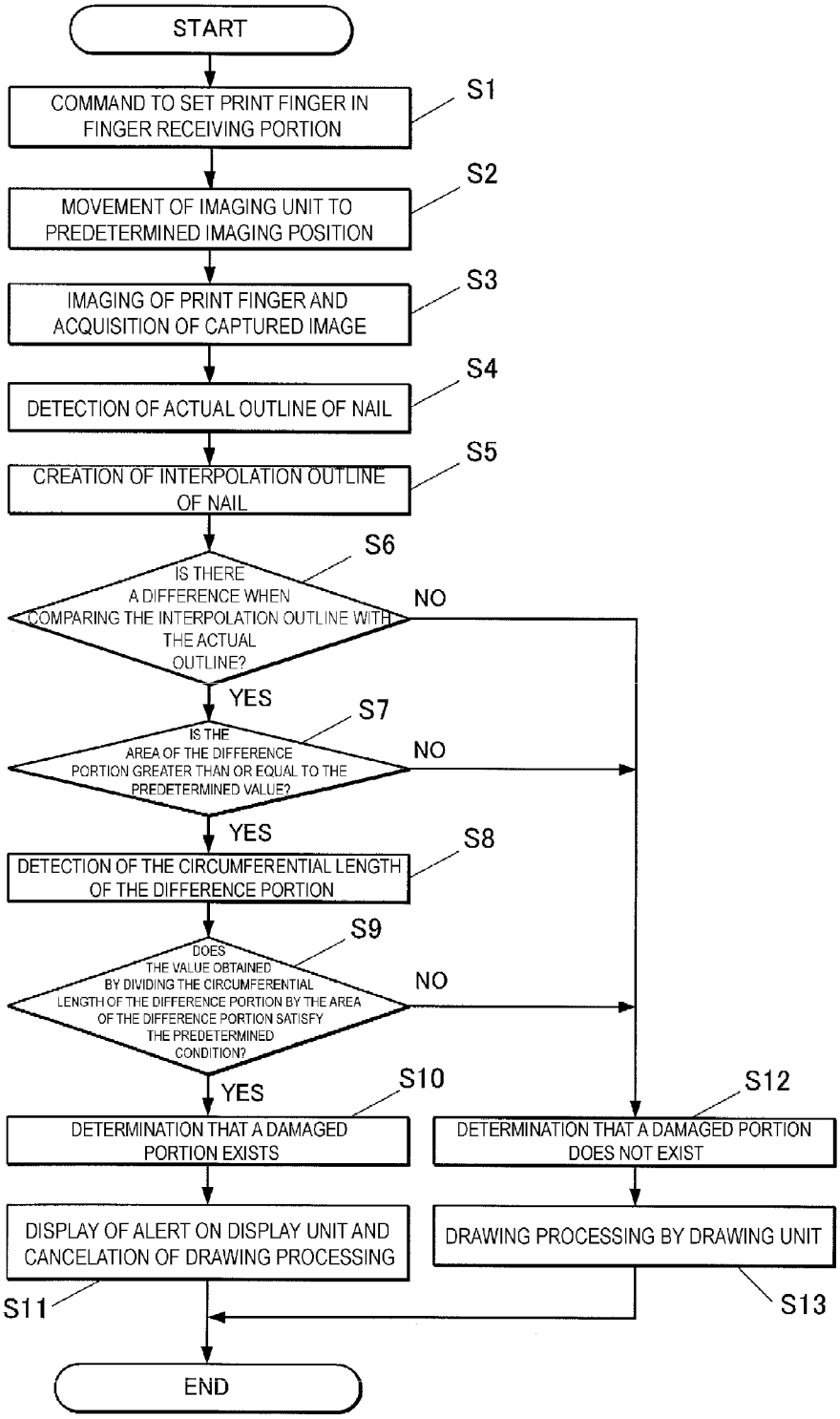
FIG. 5 is a flowchart showing damaged portion determination processing and drawing processing of the drawing apparatus according to the embodiment of the present invention.

Next, a damaged portion detection method and a drawing method by the nail printing apparatus 1 according to the present embodiment are described while referencing FIG. 5.

In cases where performing drawing using the nail printing apparatus 1, a user first operates a power switch to turn on the control device 80.

The display control portion 816 causes a design selection screen to be displayed on the display unit 26, and the user operates operation buttons or the like on the operation unit 25 and selects a desired nail design from among a plurality of nail designs displayed on the design selection screen. As a result, a selection command signal is output from the operation unit 25 and the nail design intended to be drawn on the nail T is selected.

Next, as shown in FIG. 5, the display control portion 816 causes the display unit 26 to display a command screen prompting that the print finger U1 be set in the finger receiving portion 31 (step S1).

The user operates a drawing switch (not illustrated) of the operation unit 25 after inserting the print finger U1 into the finger receiving portion 31, inserting the non-print fingers U2 into the finger clearing portion 32, and securing the print finger U1 to the finger receiving portion 31.

Upon input of a command from the draw switch and before starting the drawing operations, first, the drawing control portion 815 controls the head movement portion 49 and causes the imaging unit 50 to move to a predetermined imaging position (step S2).

For example, in cases where imaging from directly above the nail T, the head movement portion 49 is controlled so as to move the imaging unit 50 directly above the nail T.

Then, the imaging control portion 811 controls the imaging unit 50 and causes the image capturing device 51 to image the print finger U1 while illuminating the print finger U1 using the illumination device 52.

As a result, the imaging control portion 811 acquires a captured image (nail image) of the nail T of the print finger U1 that has been inserted into the finger receiving portion 31 (step S3).

Note that in cases where a plurality of captured images is acquired at different positions, the imaging unit 50 is appropriately moved by the head movement portion 49 and imaging is performed.

Upon acquisition of the captured images (the nail images), the nail shape detection portion 812 detects the actual shape of the outline of the nail T, namely the actual outline La, on the basis of the nail images (the captured images) (step S4).

The nail shape detection portion 812 detects the curvature of the nail T and other nail information on the basis of the nail images (the captured images).

Next, the damaged portion determination portion 813 creates the interpolation outline Lb of the nail T on the basis of the nail images (the captured images) (step S5).

Then, the damaged portion determination portion 813 compares the created interpolation outline Lb with the actual outline La of the nail T detected by the nail shape detection portion 812 and determines whether or not there is a difference therebetween (step S6).

Then, in cases where there is a difference therebetween (step S6; YES), the damaged portion determination portion 813 further calculates the area of the difference portion S and determines whether or not the area is greater than or equal to a certain area (e.g. 1 $mm^2$ or greater) (step S7).

In cases where the area of the difference portion S is greater than or equal to the certain area (step S7; YES), the damaged portion determination portion 813 further detects the circumferential length of the difference portion S (step S8) and determines whether or not the value obtained by dividing the circumferential length of the difference portion S by the area of the difference portion S satisfies the predetermined condition (step S9). That is, in cases where circumferential length/area<predetermined value, the damaged portion determination portion 813 determines that the predetermined condition is satisfied.

Then, in cases where the value obtained by dividing the circumferential length of the difference portion S by the area of the difference portion S satisfies the predetermined condition (step S9; YES), the damaged portion determination portion 813 determines that the difference portion S is the damaged portion Ba and determines that the nail T has the damaged portion Ba (step S10).

In these cases, the display control portion 816 causes the display unit 26 to display an alert indicating the existence of the damaged portion Ba, and the control unit 81 cancels the drawing processing (step S11).

On the other hand, (1) in cases where there is no difference between the interpolation outline Lb and the actual outline La (step S6; NO), (2) in cases where there is a difference portion but the area of the difference portion S is smaller than the certain area (step S7; NO), and (3) in cases where the area of the difference portion S is greater than or equal to the certain area but the value obtained by dividing the circumferential length of the difference portion S by the value of the area of the difference portion S does not satisfy the predetermined condition (step S9; NO), the damaged portion determination portion 813 determines that the difference portion S is not the damaged portion Ba and that the nail T does not have the damaged portion Ba (step S12).

Then, in these cases, drawing processing for drawing the nail design selected by the user on the nail T is performed by the drawing unit 40 (step S13).

Specifically, the drawing data of the nail design is generated by the drawing data generation portion 814, the drawing control portion 815 outputs the drawing data to the drawing unit 40, and the drawing is performed on the nail T by the pen 41 or the ink jet drawing portion 71 while the drawing control portion 815 operates the head movement portion 49 and causes the drawing head 43 to move appropriately.

Note that in cases where a plurality of the difference portions S is detected in step S6, the processing of step S7 to step S9 is repeated for each of the difference portions S. As a result, in cases where even one of the plurality of difference portions S is determined to be the damaged portion Ba, step S10 is carried out and it is determined that the nail T has the damaged portion Ba, the display unit 26 is caused to display the alert, and the drawing processing is canceled.

As described above, according to the present embodiment, the actual shape of the outline of the nail T, namely the actual outline La, is detected and the interpolation outline Lb of the nail T is created from the captured images of the nail T; and the actual outline La and the interpolation outline Lb are compared to each other. As a result, it is determined whether or not the nail T has the damaged portion Ba.

As such, in cases where the nail T has cracks or chips, these can be detected as the damaged portion Ba and the condition of the drawing object, namely the nail T, can be determined. Thus, the drawing processing can be safely performed.

When drawing is performed on a nail T that has the damaged portion Ba, often the nail design does not turn out as expected. However, by determining the presence or absence of the damaged portion Ba, such as in the present embodiment, the finish of the nail design can be secured and a certain degree of drawing quality can be ensured.

In the present embodiment, in cases where the interpolation outline Lb and the actual outline La are compared to each other, the difference therebetween is detected, and the detected difference portion S is greater than or equal to the certain area, the value obtained by dividing the circumferential length of the difference portion S by the value of the area of the difference portion S is taken into consideration and it is determined whether or not the nail T has the damaged portion Ba.

In these cases, provided that only fine chips and cracks have occurred, there is no obstacle to performing the drawing. As such, instead of only considering the area of the difference portion S, the value obtained by dividing the circumferential length of the difference portion by the value of the area of the difference portion is also taken into consideration. As a result, the determination of the presence or absence of the damaged portion Ba is performed while taking both the size and the shape of the difference portion S into consideration. As such, situations can be avoided where it is unnecessarily determined that the damaged portion Ba exists and drawing cannot be performed.

In the present embodiment, a configuration is provided in which in cases where it is determined by the damaged portion determination portion 813 that the nail T has the damaged portion Ba, the display unit 26 is caused to display a notification to that effect and notify (alert) the user. As a result, the user can know that the nail T is in a dangerous condition where injury may result if drawing is performed. Thus, the user can appropriately deal with the situation by, for example, filing the chipped portion of the nail to shape the nail.

The embodiment described above is for the purpose of elucidating the present invention and is not to be construed as limiting the present invention. The invention can of course be altered and improved without departing from the gist thereof.

For example, the damaged portion determination portion 813 may be configured to compare the actual outline La and the interpolation outline Lb of the nail T and, if there is a difference therebetween, determine that the damaged portion Ba exists.

A difference will appear when comparing with the interpolation outline Lb if there are irregularities in the outline of the nail T and, as such, in cases where such a determination is performed, the portion with the irregularities can be widely detected as the damaged portion Ba.

For example, the damaged portion determination portion 813 may be configured to compare the actual outline La with the interpolation outline Lb of the nail T and determine that the nail T has the damaged portion Ba in cases where there is a difference therebetween and the area of the detected difference portion S is greater than or equal to a certain area.

In cases where the area of the difference portion S is great to a certain degree, the pen tip 413 of the pen 41 will easily catch on the chipped portion and, often, the nail design does not turn out as expected.

As such, in cases where the difference portion S has such a large area, by determining that the damaged portion Ba exists without considering the shape of the difference portion S, the safety of the drawing processing can be ensured, the finish of the nail design can be secured, and a certain degree of drawing quality can be ensured.

In the present embodiment, an example is given of a case in which the processing of step S7 and on is performed in cases where the difference portion S is detected by the damaged portion determination portion 813 in step S6 of FIG. 5, regardless of the location of the difference portion S. However, in cases where the damaged portion Ba is not included in the area of the nail T where the pen 41 is expected to draw (the drawing object area), the pen tip 413 of the pen 41 will not catch on the damaged portion Ba and there is no especial danger.

As such, a configuration is possible in which the notification to the user, the cancellation of the drawing, or similar processing is performed only in cases where the damaged portion Ba is located within the drawing object area of the nail T for the nail design selected by the user.

In this case, if the damaged portion determination portion 813 detects a difference portion S caused by a chip or the like, the damaged portion determination portion 813 determines whether or not the difference portion S is located within the drawing object area of the nail T for the nail design selected by the user. In cases where the difference portion S is located outside the drawing object area, the drawing processing is performed as-is. In contrast, the processing of step S7 and on is performed only when it is determined that the difference portion S is located within the drawing object area.

In the present embodiment, an example is given of a case in which, in cases where it is determined by the damaged portion determination portion 813 that the nail T has the damaged portion Ba, measures are taken in which the user is informed to that effect, and the drawing processing is canceled. However, the measures taken when it is determined that the damaged portion Ba exists are not limited thereto.

For example, a configuration is possible in which, in cases where it is determined by the damaged portion determination portion 813 that the nail T has the damaged portion Ba, the drawing data of the nail design is corrected in the drawing data generation portion 814 such that drawing is performed while avoiding the damaged portion Ba.

Figure 6A:
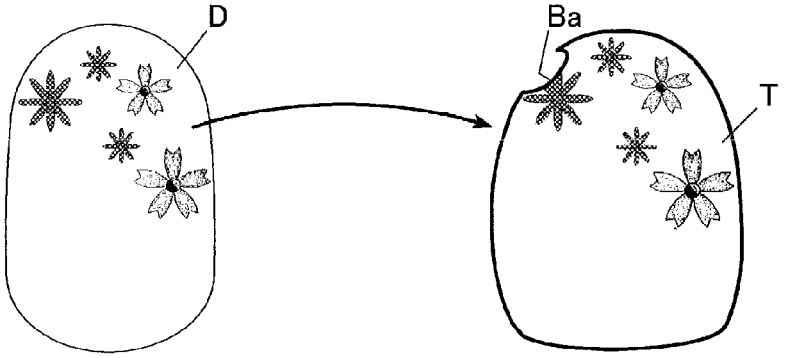
FIG. 6A is a plan view of a nail, illustrating a state where a nail design is drawn on a nail that has a damaged portion.

For example, in cases such as that illustrated on the left side in FIG. 6A where a nail design D with a flower pattern drawn near the free end of the nail is selected, and the damaged portion Ba exists on the left side of the free end portion of the nail T, if the image data of the nail design D is calibrated as-is to the nail T, as illustrated on the right side of FIG. 6A, a portion of the flower pattern will run onto the damaged portion Ba.

Figure 6B:
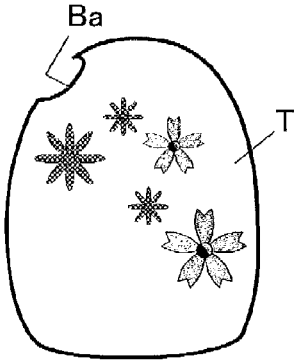
FIG. 6B is a plan view of a nail, illustrating a state where correction is performed for moving a nail design to a position where the damaged portion is avoided, and the nail design is drawn.

In such a case (that is, in a case where the damaged portion Ba is within the drawing object area), for example, as illustrated in FIG. 6B, the image data is corrected such that the nail design D is lowered to a location where the nail design D does not run onto the damaged portion Ba. As a result, the possibility of the pen tip 413 catching on the damaged portion Ba is eliminated and the desired nail design can be safely drawn.

Likewise, the possibility of the pen tip 413 catching on the damaged portion Ba can be avoided and the desired nail design D can be safely drawn by, for example, shrinking or deforming the nail design D a degree at which the drawing object area does not run onto the damaged portion Ba.

Note that in cases where taking measures by correcting or modifying the drawing data of the nail design as described above, the display unit 26 or the like may be caused to display an expected finish of a case where the drawing is performed on the basis of the corrected or modified drawing data, and the user may be requested to select whether or not to perform the drawing processing using the corrected drawing data.

For example, in cases where image data of a plurality of types of nail designs is stored in the nail design memory region 823, a configuration is possible in which the display unit 26 is caused to display the nail designs that can be drawn while avoiding the damaged portion Ba in cases where it is determined by the damaged portion determination portion 813 that the nail T has the damaged portion Ba.

In this case, for example, when the nail T has the damaged portion Ba in the middle of the free end portion, the display unit 26 or the like is caused to display the nail designs that do not include the damaged portion Ba within the drawing object area and present these nail designs to the user. Examples of such nail designs include those in which single point patterns are drawn in the middle portion of the nail T.

In this case, the display unit 26 functions as design presentation means for presenting nail designs to a user.

Then, the user re-selects a nail design from among those displayed on the display unit 26 and, thereby, drawing processing is performed for the selected nail design.

In this case, the user can freely select from among nail designs that match the condition of the nail T, and a nail design matching the preferences of the user can be safely drawn.

Note that the measures such as those described above taken in cases where it is determined, by the damaged portion determination portion 813 that the nail T has the damaged portion Ba, may be selectable by a user.

That is, in cases where informing by causing the display unit 26 to display that the damaged portion Ba exists, a configuration is possible in which the user can select from the operation unit 25 or the like whether to finish as-is without performing the drawing processing, correct or modify the selected nail design to a drawable state, or cause the display unit 26 or other design presentation means to present other drawable nail designs and re-select the nail design; and perform processing in accordance with the selection.

In the present embodiment, an example is given of a case in which, in cases where the nail T has the difference portion S, the damaged portion determination portion 813 determines whether the difference portion S constitutes the damaged portion Ba on the basis of the area thereof and the value obtained by dividing the circumferential length by the value of the area. However, the technique and determination standard for determining whether or not the difference portion S corresponds to the damaged portion Ba, and the factors used in the determination are not limited to the examples described in the present embodiment, and any are possible provided that they are suitable to enable the determination of whether or not the difference portion S is of a level where problems will not occur such as the pen tip 413 catching or the like when performing drawing by the pen 41.

In the present embodiment, a configuration has been described in which the drawing head 43 of the nail printing apparatus (the drawing apparatus) 1 is provided with the pen holder 42 that holds the pen 41 for drawing and also the ink jet drawing portion 71. However, the drawing apparatus may have a configuration in which the ink jet drawing portion 71 is not provided and the drawing is performed by only the pen 41.

In the present embodiment, an example has been given of a case where the drawing head 43 is provided with one pen holder 42. However, the number of the pen holders 42 provided in the drawing head 43 is not limited to one. For example, a configuration is possible in which two or more pen holders 42 are provided and two or more pens 41 for drawing are held.

In the present embodiment, an example has been given of a case where a user manually replaces the pen 41 held by the pen holder 42 as necessary. However, a configuration is possible in which a waiting space is provided where the pens 41 stand by in a home area 60 or the like, and the required pen 41 is automatically acquired from the waiting space and inserted into the pen holder 42 by a pen replacing mechanism (not illustrated).

In the present embodiment, an example has been given of a case where the image capturing apparatus 51 and the illumination device 52 are mounted to the drawing head 43. However, the positions at which the image capturing apparatus 51 and the illumination device 52 are provided are not limited thereto. For example, a mechanism for moving the imaging unit 50 may be provided separately from the mechanism for moving the drawing head 43.

In the present embodiment, an example has been given of the nail printing apparatus 1 in which fingers are inserted into the apparatus one finger at a time and drawing is performed sequentially. However, a configuration is also possible in which consecutive drawing can be performed on a plurality of fingers, without the need to insert and remove each finger.

The embodiment described above is not to be construed as limiting the scope of the present invention and include the scope of the invention recited in the claims and equivalents.

The invention claimed is:

1. A drawing apparatus comprising:

an object mounting portion on which an object is mounted, the object being at least one finger or toe having a nail; and a processor, wherein the processor:

detects an actual outline, which indicates an actual shape of an outer periphery of the nail, based on an image obtained by imaging the nail of the object mounted on the object mounting portion;

creates an interpolation outline with respect to the actual outline other than a root portion of the nail, from the image, wherein the interpolation outline is an outline in which the actual outline is interpolated to eliminate a concavity in cases where the actual outline other than the root portion of the nail has the concavity; and determines whether or not the nail has a damaged portion on the basis of a comparison of the interpolation outline with the actual outline.

2. The drawing apparatus according to claim 1, wherein:

the processor provides a plurality of points on the actual outline other than the root portion of the nail; and creates the interpolation outline by applying at least one of linear interpolation, polynomial interpolation, and cubic spline interpolation so as to interpolate and connect the plurality of points.

3. The drawing apparatus according to claim 1, wherein:

the processor compares the interpolation outline and the actual outline and detects a difference portion, the difference portion is a difference between the interpolation outline and the actual outline; and determines that the nail has the damaged portion in cases where a value of an area of the difference portion is greater than a preset threshold.

4. The drawing apparatus according to claim 3, further comprising a drawing unit that comprises at least one drawing tool which performs a drawing on the nail in contact with the nail; and the threshold is set in accordance with at least one of a size, a structure, and a material quality of a portion of the drawing tool that comes into contact with the nail.

5. The drawing apparatus according to claim 1, wherein:

the processor compares the interpolation outline and the actual outline and detects a difference portion, the difference portion is a difference between the interpolation outline and the actual outline; and determines whether or not the nail has the damaged portion on the basis of an area of the difference portion and a value obtained by dividing a circumferential length of the difference portion by the area of the difference portion.

6. The drawing apparatus according to claim 1, further comprising a drawing unit that performs a drawing of a selected nail design on the nail; wherein the processor compares the interpolation outline and the actual outline and detects a difference portion, the difference portion is a difference between the interpolation outline and the actual outline; and in cases where the difference portion exists within an intended drawing object area where the drawing of the nail design is to be performed on the nail by the drawing unit, defines the difference portion as the damaged portion and determines that the nail has the damaged portion.

7. The drawing apparatus according to claim 6, further comprising:

design presentation means for presenting other nail designs that can be drawn while avoiding the damaged portion in cases where the difference portion exists within the drawing object area and the processor determines that the nail has the damaged portion.

8. The drawing apparatus according to claim 6, wherein:

the processor generates drawing data for applying the nail design to the nail; and the processor corrects the drawing data so as to draw while avoiding the damaged portion in cases where the difference portion exists within the drawing object area and the processor determines that the nail has the damaged portion.

9. The drawing apparatus according to claim 6, wherein:

the drawing unit comprises at least one drawing tool which performs the drawing on the nail in contact with the nail.

10. The drawing apparatus according to claim 1, further comprising:

a notification unit for informing to that effect in cases where the processor determines that the nail has the damaged portion.

11. A drawing method for a drawing apparatus, the drawing apparatus comprising:

an object mounting portion on which an object is mounted, the object being at least one finger or toe having a nail;

the drawing method comprising:

an actual outline detection step of detecting an actual outline, which indicates an actual shape of an outer periphery of the nail, based on an image obtained by imaging the nail of the object mounted on the object mounting portion;

an interpolation outline creation step of creating an interpolation outline other than a root portion of the nail, from the image, wherein the interpolation outline is an outline in which the actual outline is interpolated to eliminate a concavity in cases where the actual outline other than the root portion of the nail has the concavity; and a damaged portion determination step of determining whether or not the nail has a damaged portion on the basis of a comparison of the interpolation outline with the actual outline.

12. The drawing method for a drawing apparatus according to claim 11, wherein:

the damaged portion detection step comprises a difference detection step of comparing the interpolation outline and the actual outline and detecting a difference portion, the difference portion is a difference between the interpolation outline and the actual outline; and in the damaged portion determination step, it is determined that the nail has the damaged portion in cases where a value of an area of the difference portion detected in the difference detection step is greater than a preset threshold.

13. The drawing method for a drawing apparatus according to claim 11, wherein:

the damaged portion detection step comprises a difference detection step of comparing the interpolation outline and the actual outline and detecting a difference portion, the difference portion is a difference between the interpolation outline and the actual outline; and in the damaged portion determination step, it is determined whether or not the nail has the damaged portion on the basis of an area of the difference portion detected in the difference detection step and a value obtained by dividing a circumferential length of the difference portion by the area of the difference portion.

14. The drawing method for a drawing apparatus according to claim 11, wherein:

the drawing apparatus further comprises a drawing unit that performs a drawing of a selected nail design on the nail; and the damaged portion determination step comprises:

a difference detection step of comparing the interpolation outline and the actual outline and detecting a difference portion, the difference portion is a difference between the interpolation outline and the actual outline; and a difference determination step of determining whether or not the difference portion detected in the difference detection step exists within an intended drawing object area where the drawing of the nail design is to be performed on the nail by the drawing unit; and in the damaged portion determination step, in cases where it is determined in the difference determination step that the difference portion exists within the drawing object area of the nail, the difference portion is defined as the damaged portion and it is determined that the nail has the damaged portion.

15. The drawing method for a drawing apparatus according to claim 14, further comprising:

a design presentation step of presenting other nail designs that can be drawn while avoiding the damaged portion, in cases where it is determined in the damaged portion determination step that the nail has the damaged portion.

16. The drawing method for a drawing apparatus according to claim 14, further comprising:

a drawing data generation step of generating drawing data for applying the nail design to the nail; and a drawing data correction step of correcting the drawing data so as to draw while avoiding the damaged portion in cases where it is determined in the damaged portion determination step that the nail has the damaged portion.

17. The drawing method for a drawing apparatus according to claim 11, further comprising:

a notification step of, in cases where it is determined in the damaged portion determination step that the nail has the damaged portion, making a notification to that effect.

* * * * *